US008256886B2

(12) United States Patent
Harris et al.

(10) Patent No.: US 8,256,886 B2
(45) Date of Patent: Sep. 4, 2012

(54) MATERIALS AND METHODS TO PRODUCE DESIRED IMAGE DRUM SURFACE TOPOGRAPHY FOR SOLID INK JET

(75) Inventors: Sean W. Harris, Portland, OR (US); David Ruff, Sherwood, OR (US); Mark Taft, Tualatin, OR (US); Katherine D. Weston, Lansdale, PA (US); Barry Daniel Reeves, Lake Oswego, OR (US); Jignesh Sheth, Wilsonville, OR (US); Paul McConville, Webster, NY (US); David Alan VanKouwenberg, Avon, NY (US); Pinyen Lin, Rochester, NY (US); Trevor Snyder, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 267 days.

(21) Appl. No.: 12/835,557

(22) Filed: Jul. 13, 2010

(65) Prior Publication Data

US 2012/0013691 A1 Jan. 19, 2012

(51) Int. Cl.
*B41J 2/01* (2006.01)

(52) U.S. Cl. ..... 347/101

(58) Field of Classification Search ..... None
See application file for complete search history.

*Primary Examiner* — Stephen Meier
*Assistant Examiner* — Tracey McMillion
(74) *Attorney, Agent, or Firm* — MH2 Technology Law Group LLP

(57) ABSTRACT

Exemplary embodiments provide an aluminum image drum and method of its formation such that the aluminum image drum can have a surface texture to provide desirable surface oil consumption and high print quality for solid ink jet marking systems.

20 Claims, 7 Drawing Sheets

MATERIALS AND METHODS TO PRODUCE DESIRED IMAGE DRUM SURFACE TOPOGRAPHY FOR SOLID INK JET

RELATED APPLICATION

The present disclosure is related to concurrently-filed application Ser. No. 12/835,359, filed on Jul. 13, 2010, and entitled "Surface Finishing Process for Indirect or Offset Printing Components", the disclosure of which is incorporated herein by reference.

DETAILED DESCRIPTION

1. Field of Use

The present teachings relate generally to an image transfer member used in solid ink jet marking systems and, more particularly, to materials and methods of an image transfer member having a surface topography for solid ink jet.

2. Background

In one type of solid ink jet printing, ink is jetted from a printhead to an aluminum image drum and then transferred and fixed (i.e., transfixed) onto a final print medium (e.g., paper). During this process, jetted images are disposed on a release layer that is applied on the aluminum image drum surface. The release layer includes release oils, such as fluorinated oils, mineral oils, silicone oils, or other certain functional oils in order to maintain good release properties of the image drum and thus to support the transfer of the printed image onto the final print medium.

The correlation between surface roughness, composition, and crystal structures of conventional aluminum image drums and image quality is not well understood. It is known, however, that the interaction between the aluminum image drum surface and the release oil layer plays an important role for transferring the jetted image. For example, the surface roughness or surface texture of the aluminum image drum is related to the oil consumption rate on the drum surface. Specifically, while a certain level of surface texture is desirable, too much texture is a problem because it significantly increases oil consumption. The significantly increased oil consumption in turn increases operational costs and image dropout on the final print medium. On the other hand, too little surface texture or too smooth a surface often results in a low oil consumption rate, i.e., a low oil retention, which may cause paper path smudges, high gloss levels, and/or image dropout on the printed image.

Thus, there is a need to overcome these and other problems of the prior art and to provide an image drum having suitable surface texture useful for solid ink jet marking systems and a method for making the image drum.

SUMMARY

According to various embodiments, the present teachings include an aluminum drum for a solid ink jet marking system. The aluminum drum can include a surface texture. The surface texture can have an average surface roughness ranging from about 0.05 microns to about 0.7 microns, and a bearing area ranging from about 2% to about 100% at a cut depth ranging from about 0.1 microns to about 1 micron. A relationship between the bearing area and the cut depth can be selected from one or more sets including a bearing area ranging from about 7% to about 46% at a cut depth ranging from about 0.1 microns to about 0.2 microns; a bearing area ranging from about 18% to about 74% at a cut depth ranging from about 0.2 microns to about 0.3 microns; a bearing area ranging from about 32% to about 82% at a cut depth ranging from about 0.3 microns to about 0.4 microns; a bearing area ranging from about 47% to about 86% at a cut depth ranging from about 0.4 microns to about 0.5 microns; a bearing area ranging from about 60% to about 89% at a cut depth ranging from about 0.5 microns to about 0.6 microns; and/or a bearing area ranging from about 70% to about 95% at a cut depth ranging from about 0.6 microns to about 0.7 microns. These one or more sets of bearing area/cut depth are also listed in Table 3, which will be described later in great details.

According to various embodiments, the present teachings also include a method for forming an image drum for a solid ink jet marking system. In this method, a base surface texture can be formed in an outer surface of an aluminum drum by using and controlling one or more processes of a chemical process, a mechanical process, and a combination thereof. An anodization of this aluminum drum can be followed to form an oxide layer in the base surface texture. The base surface texture of the anodized aluminum drum can then be mechanically fine-tuned to provide an average surface roughness ranging from about 0.1 microns to about 0.6 microns and an average maximum profile peak height of less than about 0.6 microns.

According to various embodiments, the present teachings further include a solid ink jet marking system. The solid ink jet marking system can include a printhead having a plurality of printhead nozzles configured to jet inks onto an aluminum image drum. The aluminum image drum can be configured in contact with a print medium to transfer the jetted inks from the aluminum image drum to the print medium. The aluminum image drum can include a surface texture having a bearing area ranging from about 5% to about 95% at a cut depth ranging from about 0.1 microns to about 0.7 microns. A relationship between the bearing area and the cut depth can be selected from one or more sets as listed in Table 3, which will be described later in great details.

According to various embodiments, the present teaching further include a direct to paper marking system with an ink spreader. The direct to paper marking system can include one or more printheads configured to form a fully populated array as in a single-pass architecture, or a partially populated array as in a multi-pass architecture. The aluminum drum can be configured as a spreader which is used to spread and fuse the ink into the media. The aluminum spreader drum can include a surface texture having a bearing area ranging from about 5% to about 95% at a cut depth ranging from about 0.1 microns to about 0.7 microns. A relationship between the bearing area and the cut depth can be selected from one or more sets as listed in Table 3, which will be described later in great details.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Exemplary embodiments provide an image transfer member having a surface texture useful for solid ink jet marking systems and methods for controlling the surface texture during its formation. Due to the controllable surface texture of the image transfer member, surface wetting, e.g., by release oil such as silicon oil, and release oil transferring to prints, can then be reduced or eliminated.

Figure 1A:
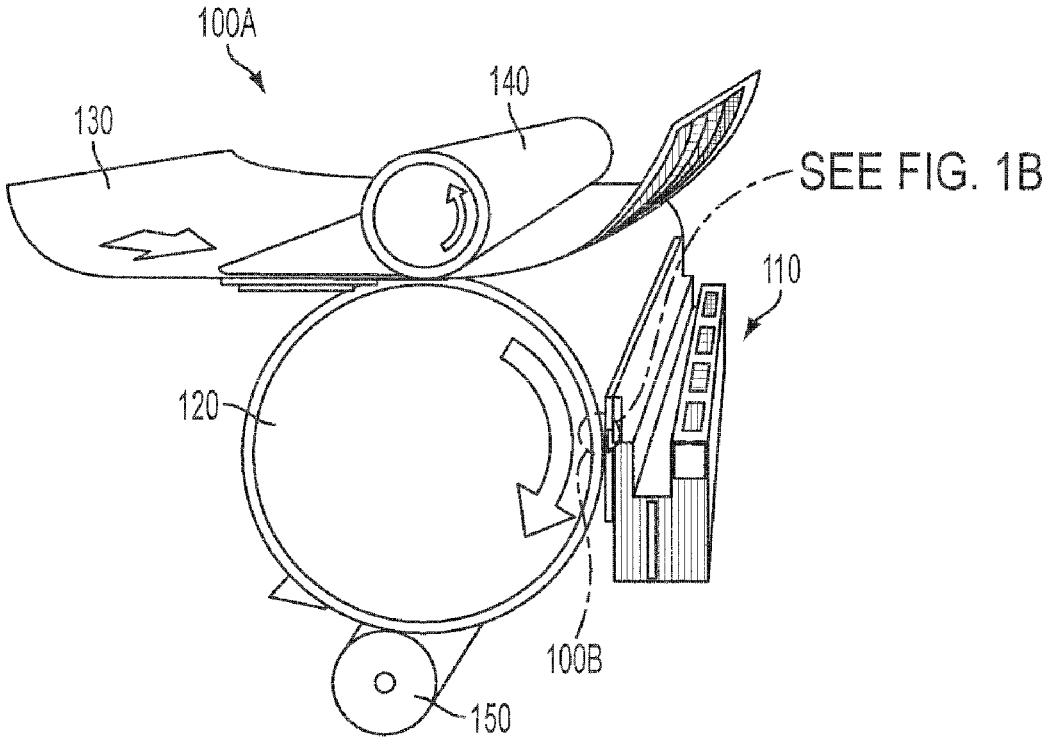
FIGS. 1A-1B depict an exemplary solid ink marking system in accordance with various embodiments of the present teachings.
Figure 1B:
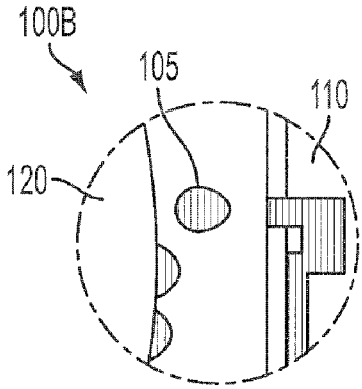
Figure 1C:
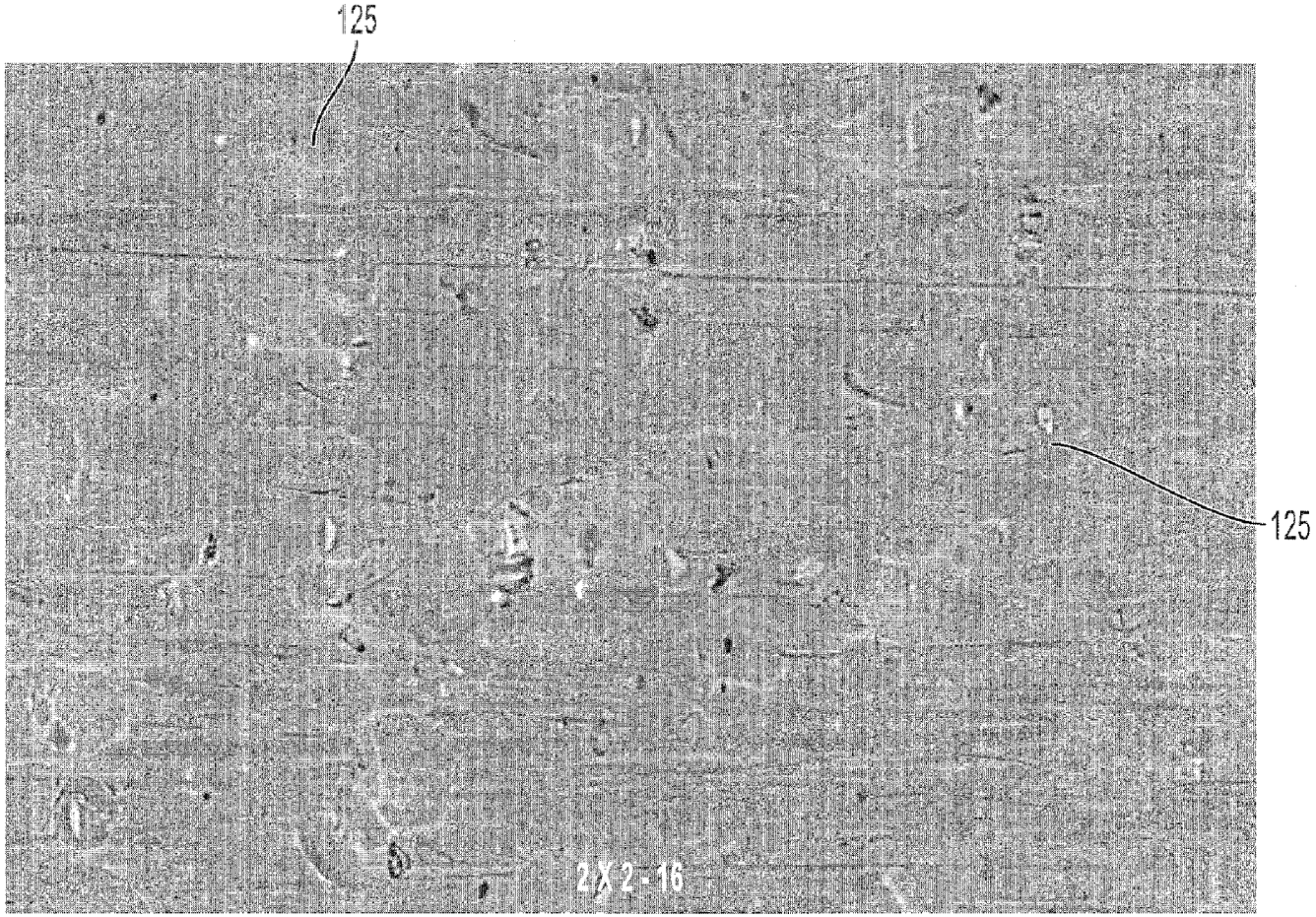
FIG. 1C depicts an exemplary surface topography of an aluminum drum in FIGS. 1A-1B in accordance with various embodiments of the present teachings.

FIGS. 1A-1B depict an exemplary solid ink jet marking system 100A in accordance with various embodiments of the present teachings. FIG. 1C depicts an exemplary surface texture of an exemplary aluminum drum for the solid ink jet marking system of FIGS. 1A-1B in accordance with various embodiments of the present teachings.

In embodiments, the solid ink jet marking system 100A can have, for example, an offset printing architecture, and can include printhead nozzles 110, an image drum 120, a print medium 130, a transfix roller or a pressure roller 140, and a drum maintenance element 150.

As shown in FIGS. 1A-1B, the printhead nozzles 110 can jet the ink 105 onto the surface of an intermediate image transfer member, for example, the image drum 120 to form a solid ink image layer on the drum surface. The print medium 130, for example, a paper sheet or a transparent film, can be brought into contact with the image drum 120. The ink image can then be transferred and fixed (i.e., transfixed) to the print medium 130 by using the transfix roller 140 as known to one of ordinary skill in the art. The drum maintenance element 150 can provide a thin layer of release oil on the image drum 120 for receiving and then transferring the jetted images.

Figure 2:
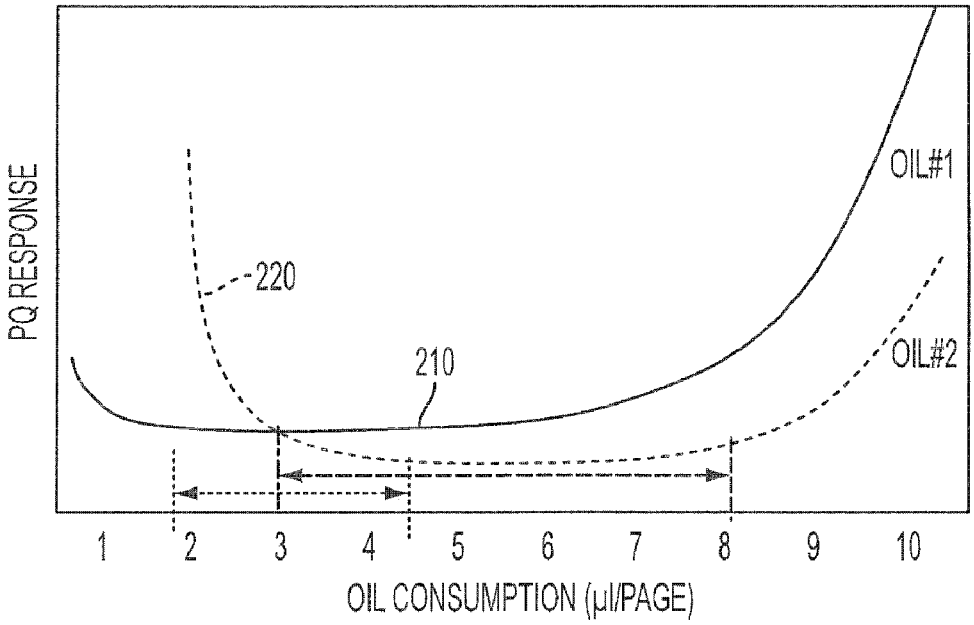
FIG. 2 depicts a relationship between print quality (PQ) and oil consumption (OC) rate of an exemplary machine design in accordance with various embodiments of the present teachings.

In embodiments, the image drum 120 can be, for example, an aluminum image drum having a surface texture, which allows for suitable surface oil consumption (OC) and thus high print quality. FIG. 2 depicts a relationship between print quality (PQ) and oil consumption (OC) rate of an exemplary machine design in accordance with various embodiments of the present teachings.

In this specific example as illustrated in FIG. 2, at 210, suitable oil consumption (OC) rate for the exemplary oil #1 can range from about 2 microliters per page to about 4 microliters per page. At 220, suitable oil consumption (OC) rate for the exemplary oil #2 can range from about 3 microliters per page to about 8 microliters per page in order to provide high print quality.

As disclosed herein, the surface of the image drum 120 can have desirable oil consumption, which can avoid stripper smudge, rib smudge, or other print defect caused by the stripping mechanism in the transfix region. This can also avoid high duplex dropouts, high simplex dropouts, or any failure to transfer ink pixels from the image drum 120 to the print medium 130. In embodiments, the image drum 120 can have an oil consumption rate, for example, ranging from about 0.1 microliters per page to about 20 microliters per page, or from about 0.5 microliters per page to about 15 microliters per page, or from about 1 microliter per page to about 10 microliters per page. It is to be understood that the oil consumption rate can be an average rate based on solid fill print of about 100% ink coverage. However, the actual rate seen by a customer will be less and depend on the range of typical prints. The typical print range can include, among other variables, variations of media type, environmental conditions, image density, and/or color and area of coverage.

In embodiments, the image drum 120 can have a surface texture or topography including nano- or micro-surface structures with various regular or irregular topographies. For example, the surface structures can include periodical and/or ordered nano-, micro-, or nano-micro-surface structures. In exemplary embodiments, the disclosed surface texture can include protrusive or intrusive features.

Figure 1D:
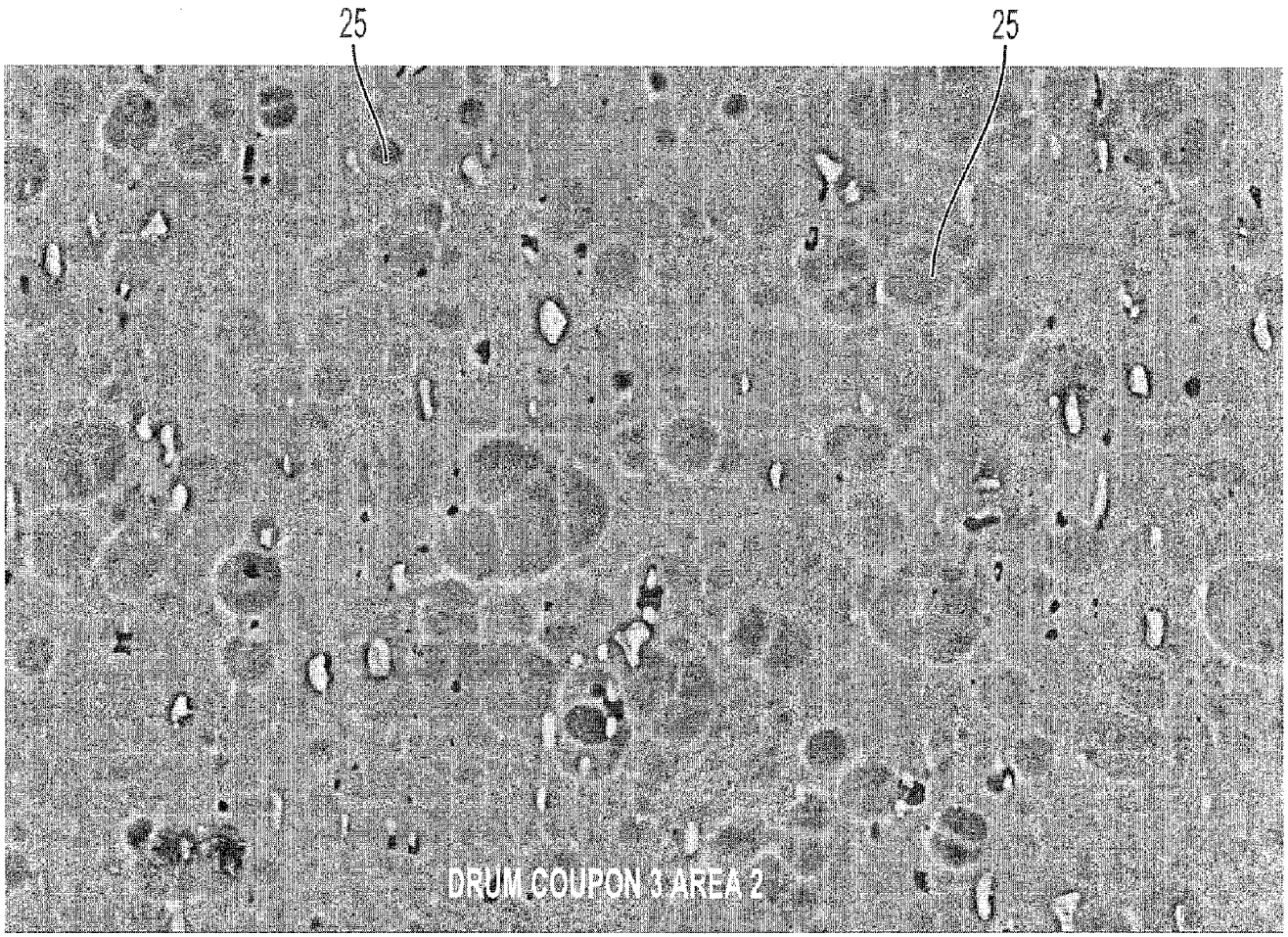
FIG. 1D PRIOR ART
FIG. 1D depicts a conventional aluminum surface.

As exemplarily shown in FIG. 1C, the surface texture of the aluminum drum 120 can include a plurality of pit structures 125, dimples or other intrusive structures. In embodiments, the exemplary pit structures 125 can be defined and separated by pit protuberances. For comparison, conventional aluminum drum in FIG. 1D can include a plurality of conventional pit structures 25.

In embodiments, the pit structures 125 and/or pit protuberances can have various cross-sectional shapes, such as, for example, square, rectangle, circle, star, or any other suitable shape. In various embodiments, the size and shape of the pit structures 125 and/or pit protuberances can be arbitrary or irregular.

Various known techniques can be used to measure the surface texture. For example, a contact profilometer or a noncontact interferometer can be used to characterize the surface texture.

In general, surface characterization can be significantly affected by the measuring techniques including the instruments, software, and/or electrical setup that are used for the measurement. For example, Zeiss Surfcom 130A available from Ford Tool and Gage (Milwaukee, Wis.) can be used to define the surface texture of the disclosed image drum 120. Specifically, Table 1 lists exemplary measuring parameters when using Zeiss Surfcom 130A.

The measuring results of the surface texture of the image drum 120 can include amplitude parameters, slope parameters, bearing ratio parameters, etc. Among those, Ra denotes an arithmetic average of absolute values of the roughness profile ordinates; Rp denotes a max height of any peak to a mean line of the roughness within one sampling length; and bearing area curve (BAC) denotes a plot of bearing area or bearing length ratio at different cut depths or heights of the surface's general form. Mathematically, the bearing area curve is the cumulative probability density function of the surface profile's height (or cut depth) and can be calculated by integrating the profile trace. It is believed that the peak height and/or bearing area are significant indicators of the oil consumption rate of the aluminum surfaces. For example, absent attainment of the bearing area or Rp values as disclosed herein may result in undesired oil consumption rates, even if other values of typical surface texture measurements are equivalent for the aluminum surfaces.

TABLE 1

| Parameters | |
|---|---|
| Evaluation length | 4 mm |
| Speed | 0.3 mm/s |
| Cutoff | 0.8 mm |
| Cutoff type | Gaussian |
| Range | ±40.0 μm |
| Tilt | Straight |
| Cutoff filter ratio | 300 |
| Pc upp-L | 0.600 μm |
| Pc low-L | 0.000 μm |
| Method of BAC curve cut level | Absolute |
| Method of BAC curve | DIN4776 (ISO 13565) |
| Output method of Rmr | Individual value |
| Probe tip | 2 μm 60 degree conical diamond |
| Tilt correction | Least square straight (LSS) |

In embodiments, the image drum 120 having the disclosed surface texture or topography can have an average surface roughness (Ra), for example, ranging from about 0.05 microns to about 0.7 microns, or from about 0.1 microns to about 0.6 microns, or from about 0.2 microns to about 0.4 microns.

Typically, conventional aluminum surfaces (e.g., prepared using only caustic etch/anodize techniques) have an average roughness of about 0.2 to about 0.6 microns (see FIG. 1D), which is within the range for the disclosed aluminum surfaces. However, Rp value and/or bearing area at certain cut depth of the disclosed aluminum surfaces can be significantly different from the conventional aluminum surfaces, that is, falling outside the Rp value and/or bearing area of conventional aluminum surfaces.

TABLE 2

| | Drum | Ra (micron) | Rp (micron) |
|---|---|---|---|
| No. 1 | Conventional | 0.26 | 0.67 |
| | Disclosed | 0.18 | 0.37 |
| No. 2 | Conventional | 0.55 | 0.88 |
| | Disclosed | 0.22 | 0.47 |
| No. 3 | Conventional | 0.25 | 0.73 |
| | Disclosed | 0.28 | 0.42 |

For example, as shown in Table 2, conventional aluminum surfaces (see FIG. 1D) have an average maximum profile peak height (Rp) of about 0.6 microns to about 0.9 microns, while the disclosed aluminum surface (see FIG. 1C) can have an average maximum profile peak height (Rp) of less than about 0.6 microns, for example, between about 0.05 microns and about 0.6 microns, or ranging from about 0.2 microns to about 0.6 microns.

Figure 1E:
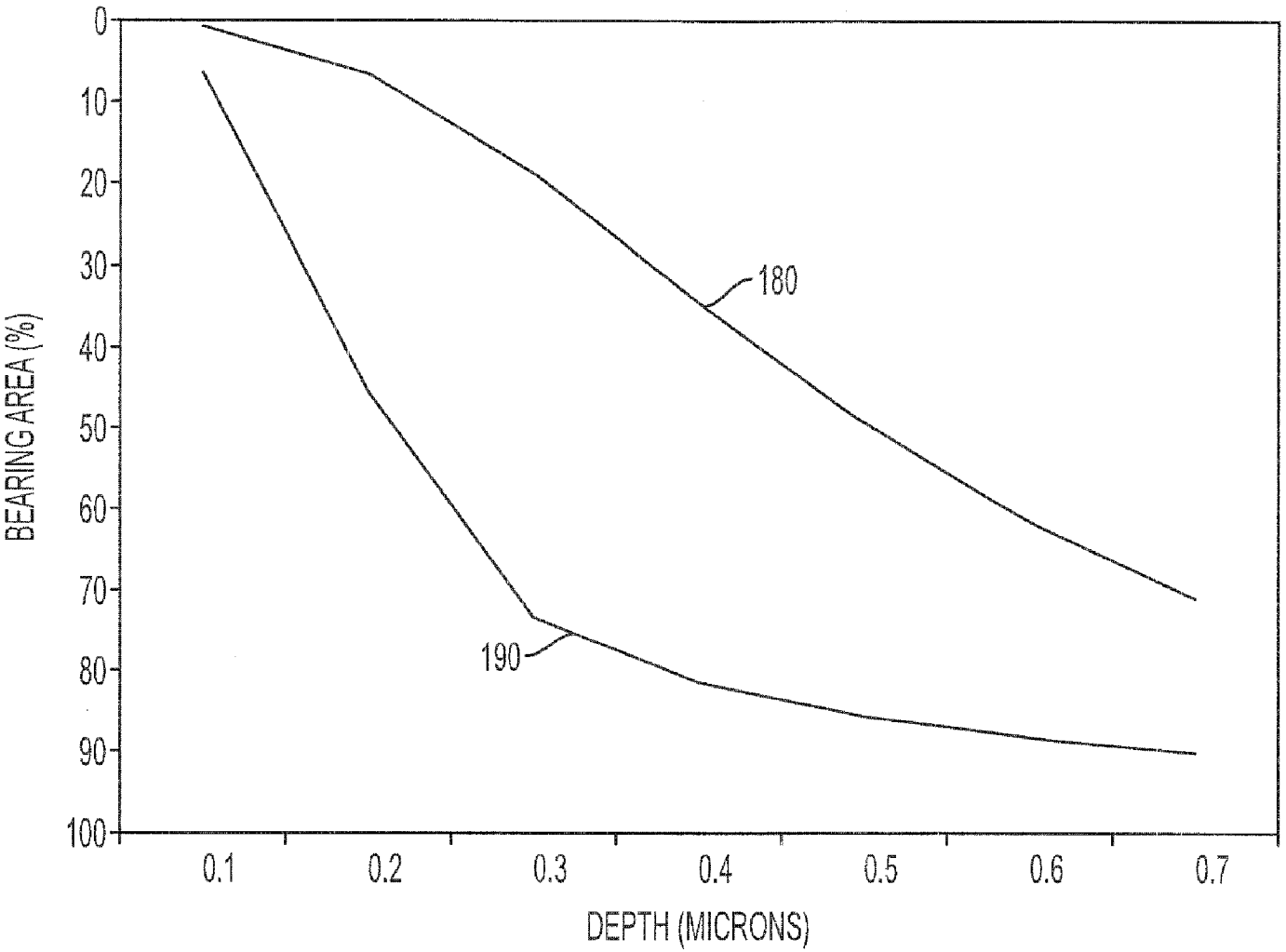
FIG. 1E depicts profilometry results of an exemplary surface texture in accordance with various embodiments of the present teachings.

FIG. 1E depicts profilometry results of an exemplary drum surface texture using the instrument of Zeiss Surfcom 130A with specifications listed in Table 1 in accordance with various embodiments of the present teachings. Specifically, the profilometry results in FIG. 1E show the bearing area as a function of the cut depth. As shown, the curve 180 and the plotted region above the curve 180 show a bearing area at various associated cut depths for conventional aluminum drums, indicating a too rough surface. In contrast, an integral region under the curve 180 in FIG. 1E shows a bearing area at various associated cut depths for the disclosed aluminum drum surfaces. In exemplary embodiments, the disclosed aluminum drum surface can have a bearing area at various associated cut depths corresponding to an integral region that is between the curve 180 and a curve 190 in FIG. 1E, wherein the plotted region under the curve 190 indicates a too smooth surface.

In embodiments, exemplary image drums can have a bearing area ranging from about 2% to about 100%, or ranging from about 5% to about 95% at a cut depth ranging from about 0.1 microns to about 1 micron, or ranging from about 0.1 microns to about 0.7 microns. For example, as shown in FIG. 1E, the exemplary aluminum drum surfaces can exhibit a bearing area ranging from about 2% to about 7% at a cut depth of about 0.1 microns; a bearing area ranging from about 7% to about 46% at a cut depth of about 0.2 microns; a bearing area ranging from about 18% to about 74% at a cut depth of about 0.3 microns; a bearing area ranging from about 32% to about 82% at a cut depth of about 0.4 microns; a bearing area ranging from about 47% to about 86% at a cut depth of about 0.5 microns; a bearing area ranging from about 60% to about 89% at a cut depth of about 0.6 microns, and/or a bearing area ranging from about 70% to about 95% at a cut depth of about 0.7 microns.

Additionally, Table 3 depicts various exemplary sets of bearing area/cut depth that fall within the desirable region between the two curves 180 and 190 as described above.

TABLE 3

| | Cut Depth (microns) | | | | | |
|---|---|---|---|---|---|---|
| | 0.1-0.2 | 0.2-0.3 | 0.3-0.4 | 0.4-0.5 | 0.5-0.6 | 0.6-0.7 |
| Bearing area (%) | 7-46 | 18-74 | 32-82 | 47-86 | 60-89 | 70-95 |

As disclosed, while the surface roughness of the disclosed aluminum surface encompasses the roughness of conventional aluminum surfaces, the combination with Rp value and/or the bearing area at certain cut depth can allow the disclosed image drums significantly different from conventional aluminum drums. Suitable surface oil consumption and thus high print quality can then be achieved.

Further, the disclosed image drum can have an average pit density ranging from about 100 per millimeter square to about 40,000 per millimeter square, or ranging from about 1000 per millimeter square to about 30,000 per millimeter square, or ranging from about 2500 per millimeter square to about 25,000 per millimeter square. In embodiments, the image drum 120 can have an average pit size or a mean pit diameter, for example, ranging from about 0.1 microns to about 25 microns, or from about 0.1 micron to about 20 microns, or from about 2 microns to about 15 microns.

In various embodiments, the surface texture/topography of the image drum can have hierarchical surface texture having periodical structures on two or more scales. Examples can include fractal and self-affined surfaces that refers to a fractal one in which its lateral and vertical scaling behavior is not identical but is submitted to a scaling law.

In embodiments, the surface texture of the aluminum drum can be controlled during its formation by, for example, controlling Al alloy compositions and crystalline structures, controlling surface treatment chemistries/conditions, etc.

The exemplary aluminum image drum can be formed from Al-containing alloys having elements including, but not limited to, Aluminum (Al), Manganese (Mn), Iron (Fe), Silicon (Si), Copper (Cu), and Chromium (Cr). In embodiments, the aluminum alloy for forming the disclosed aluminum image drum can include, for example, at least about 97% of Aluminum by weight of the total aluminum drum. In embodiments, Manganese (Mn) can be used, having about 2% or less by weight of the total aluminum drum. In embodiments, Iron (Fe) can be used, having about 1% or less by weight of the total aluminum drum.

Figure 3:
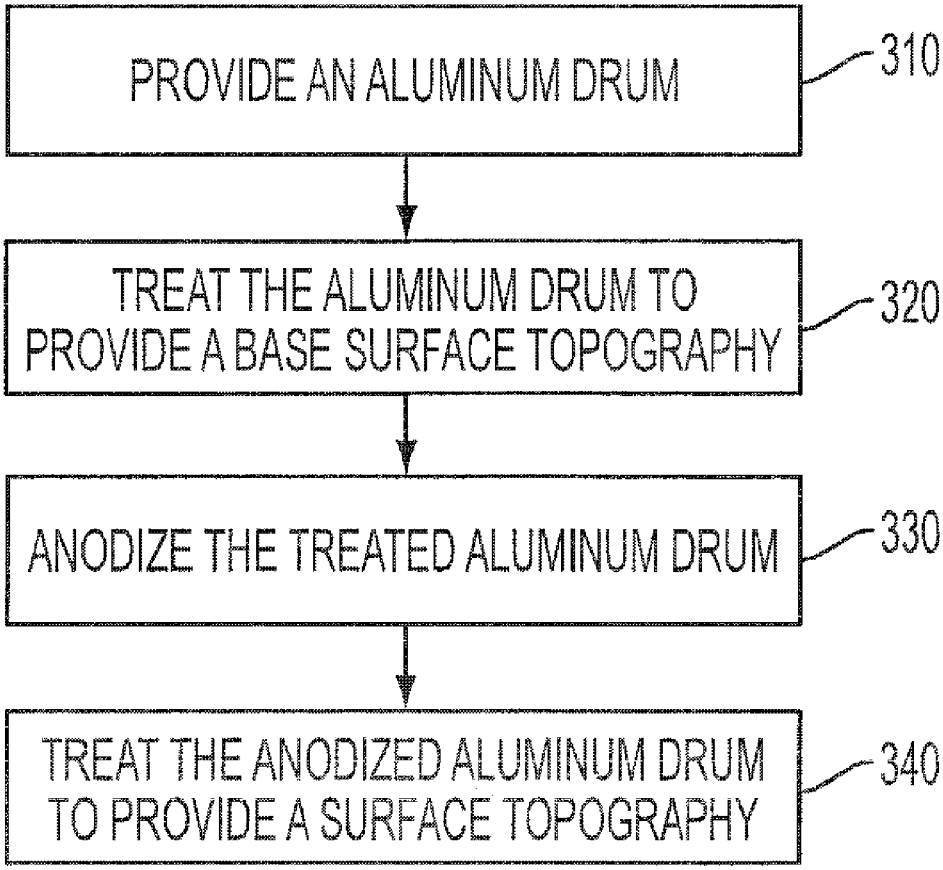
FIG. 3 depicts an exemplary method for forming an image drum in accordance with various embodiments of the present teachings.

FIG. 3 depicts an exemplary method for forming an image drum having the disclosed surface texture in accordance with various embodiments of the present teachings. In embodiments, SEM (scanning electronic microscope) techniques and/or white light interferometry can be used to monitor surface texture of the image drum at various formation stages.

At 310 in FIG. 3, an aluminum drum can be provided as disclosed herein. The provided aluminum drum can include, for example, 3000 series aluminum, or 6000 series aluminum, as base materials for aluminum drums as known to one of ordinary skill in the art.

At 320 in FIG. 3, the provided aluminum drum can be treated so as to provide a base drum surface, which can be formed by a plurality of base pit structures and can have a base surface texture and/or roughness. In embodiments, the base surface of the image drum can be further processed to provide a final drum surface having the disclosed final surface texture as described in FIGS. 1A-1C and 1E.

In embodiments, the provided aluminum drum can be treated by, for example, a chemical treatment, a mechanical treatment and/or a combination thereof. The chemical treatment can include an etching process, including a wet or dry etching such as a caustic etching or an acid dip; while the mechanical treatment can include a polishing or a roughening process including, but not limited to, a lapping process, an abrasion blasting process, a buffing process, and/or a turning process.

The base surface texture/topography and therefore the final surface texture/topography of the image drum 120 can be controlled by the treatment of 320 in FIG. 3. For example, when an etching process is involved, the etching chemistries and the etching conditions, such as the etching time and the etching temperature, can be controlled to provide a desirable base and then final surface texture for the image drum 120. In an exemplary embodiment, the etching process can include various different chemicals including acids and bases, for example, sodium hydroxide. The etching temperature can be about 35° C. or higher, for example, ranging from about 35° C. to about 75° C., or higher than 75° C. The etching time length can be about 30 seconds or longer, for example, ranging from about 30 seconds to about 200 seconds, or longer than 200 seconds. As a result, the surface texture of the etched aluminum drum can be controllably changed and optimized.

Figure 4:
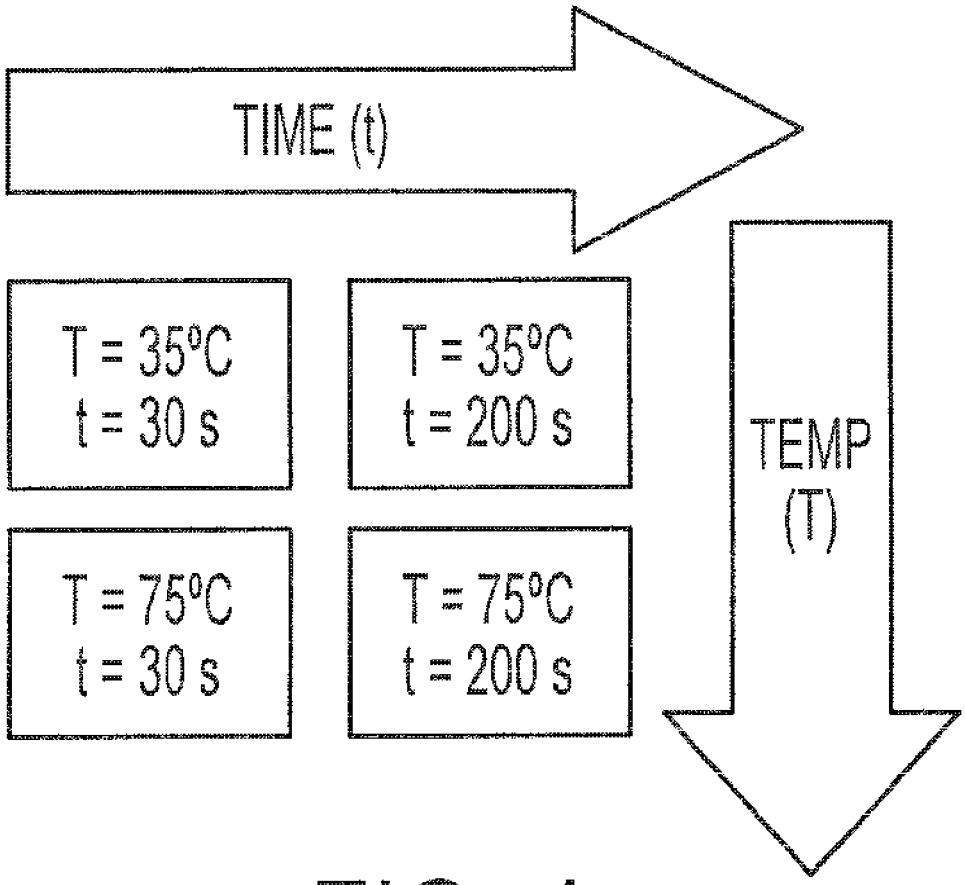
FIG. 4 depicts an exemplary design of experiment (DOE) for an aluminum surface control in accordance with various embodiments of the present teachings.

FIG. 4 depicts an exemplary design of experiment (DOE) for the aluminum surface control by an etching step prior to an anodization process (see 330 in FIG. 3).

The exemplary 2×2 DOE of FIG. 4 shows an etching time of about 30 seconds or about 200 seconds and an etching temperature of about 35° C. or about 75° C. The etching solution can include sodium hydroxide, which has a nominal etching temperature of about 55° C. As observed from SEM images (not shown), the etching sites on the drum surface can nucleate and grow, when etched at about 35° C. for about 30 seconds. The pit structures can grow and some pits can merge together, when etched at about 75° C. for about 200 seconds. In this manner, the base surface texture can be controlled by adjusting these parameters of the etching temperature and the etching time.

In embodiments, slight difference on aluminum compositions and/or aluminum crystalline structures can change the surface texture of the aluminum image drum 120.

For example, 3000 series aluminum such as 3003 type of aluminum drums can all contain about 98% aluminum. However, slight difference between drum alloy compositions can have effects on crystalline structure, size and/or orientation, size of insoluble domains in the alloy, etc. during the formation of the disclosed aluminum image drum 120. Changes and etching characteristics of the surface texture can be adjusted to form a desirable aluminum drum. In the example including 3003 aluminum drums, one drum can have a more suitable oil consumption (OC) rate and better print quality due to its surface texture having high pit density and small pit sizes as compared with the other drum.

At 330 of FIG. 3, the chemically and/or mechanically treated aluminum drum can then be anodized to conformally form a layer of aluminum oxide and to provide a surface hardness for the aluminum drum. For example, the aluminum oxide layer can have a thickness ranging from about 2 μm to about 30 μm, or ranging from about 5 μm to about 25 μm, or ranging from about 8 μm to about 20 μm. Any known anodization process can be used in accordance with various embodiments of the present teachings.

Optionally, a sealing process can be used following the anodization process of the aluminum drum. In embodiments, various sealants and their combinations can be used to fill pores or holes in the anodized aluminum drum. Such pores or holes can be created from the anodization process at 330, for example, and can have an average size ranging from about 5 nanometers to about 500 nanometers, or ranging from about 5 nanometers to about 200 nanometers, or ranging from about 50 nanometers to about 100 nanometers.

In embodiments, the anodized aluminum drum can be sealed with a polymer sealant having a low surface energy. The polymer sealant can include, for example, polytetrafluoroethylene. Alternatively, the anodized aluminum can be sealed with a metal fluoride sealant including, for example, nickel fluoride.

At 340 of FIG. 3, following the anodization process and/or the optional sealing process, a secondary treatment can be performed on the resultant surface of the image drum. In embodiments, the secondary treatment can include a mechanical polishing or a roughening process to fine-tune (e.g., to increase or decrease surface roughness from the base surface roughness) the surface texture as described in FIGS. 1A-1C and FIG. 1E. In addition, the secondary treatment following the anodization process can remove impurities on the drum surface, which may have been deposited from previous processes.

After the secondary treatment, the treated aluminum oxide layer can have a thickness ranging from about 1 μm to about 25 μm, or ranging from about 2 μm to about 22 μm, or ranging from about 5 μm to about 18 μm.

In embodiments, various steps described above in FIG. 3 may be added, omitted, combined, altered, or performed in different orders. As compared with aluminum surfaces prepared using conventional techniques that only include caustic etch and anodization, the aluminum surfaces prepared and controlled by the disclosed method can have the disclosed surface texture as described in FIGS. 1A-1C and 1E.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An aluminum drum for an ink jet marking system comprising:

a surface texture having an average surface roughness ranging from about 0.05 microns to about 0.7 microns, and a bearing area ranging from about 2% to about 100% at a cut depth ranging from about 0.1 microns to about 1 micron; wherein a relationship between the bearing area and the cut depth is selected from one or more sets comprising:

the bearing area ranging from about 7% to about 46% at the cut depth ranging from about 0.1 microns to about 0.2 microns;

the bearing area ranging from about 18% to about 74% at the cut depth ranging from about 0.2 microns to about 0.3 microns;

the bearing area ranging from about 32% to about 82% at the cut depth ranging from about 0.3 microns to about 0.4 microns;

the bearing area ranging from about 47% to about 86% at the cut depth ranging from about 0.4 microns to about 0.5 microns;

the bearing area ranging from about 60% to about 89% at the cut depth ranging from about 0.5 microns to about 0.6 microns; and the bearing area ranging from about 70% to about 95% at the cut depth ranging from about 0.6 microns to about 0.7 microns.

2. The drum of claim 1, wherein the surface texture comprises an average maximum profile peak height of less than about 0.6 microns.

3. The drum of claim 1, wherein the surface texture comprises an average maximum profile peak height ranging from about 0.2 microns to about 0.6 microns.

4. The drum of claim 1, wherein the surface texture has an average pit size ranging from about 0.1 microns to about 20 microns, and an average pit density ranging from about 1000 per millimeter square to about 30,000 per millimeter square.

5. The drum of claim 1, wherein the aluminum drum comprises an alloy element selected from the group consisting of Aluminum (Al), Manganese (Mn), Iron (Fe), Silicon (Si), Copper (Cu), Chromium (Cr), and a combination thereof.

6. A method for forming an image drum for a solid ink jet marking system comprising:

providing an aluminum drum;

controlling one or more processes selected from the group consisting of a chemical process, a mechanical process, and a combination thereof to form a base surface texture in an outer surface of the aluminum drum;

anodizing the aluminum drum to conformally form an oxide layer in outer surface of the aluminum drum; and mechanically fine-tuning the base surface texture of the anodized aluminum drum such that the mechanically fine-tuned surface texture has an average surface roughness ranging from about 0.1 microns to about 0.6 microns and an average maximum profile peak height of less than about 0.6 microns.

7. The method of claim 6, wherein the mechanically fine-tuned surface texture has a bearing area ranging from about 5% to about 95% at a cut depth ranging from about 0.1 microns to about 0.7 microns; wherein a relationship between the bearing area and the cut depth is selected from one or more sets comprising:

the bearing area ranging from about 7% to about 46% at the cut depth ranging from about 0.1 microns to about 0.2 microns;

the bearing area ranging from about 18% to about 74% at the cut depth ranging from about 0.2 microns to about 0.3 microns;

the bearing area ranging from about 32% to about 82% at the cut depth ranging from about 0.3 microns to about 0.4 microns;

the bearing area ranging from about 47% to about 86% at the cut depth ranging from about 0.4 microns to about 0.5 microns;

the bearing area ranging from about 60% to about 89% at the cut depth ranging from about 0.5 microns to about 0.6 microns; and the bearing area ranging from about 70% to about 95% at the cut depth ranging from about 0.6 microns to about 0.7 microns.

8. The method of claim 6 further comprising sealing a pore in the anodized aluminum drum that has an average pore size ranging from about 5 nanometers to about 500 nanometers using a sealant, wherein the sealant comprises a polymer sealant, a metal fluoride sealant, and a combination thereof.

9. The method of claim 6, wherein the mechanical process comprises a lapping process, an abrasion blasting process, a buffing process, or a turning process, and wherein the chemical process comprises a wet etching using sodium hydroxide or an acid dip.

10. The method of claim 6 further comprising controlling an etching temperature, an etching time, or an alloy composition of the aluminum drum prior to the anodizing step in order to control the base surface texture.

11. The method of claim 6, wherein the mechanically fine-tuned surface texture has an average pit size ranging from about 0.1 microns to about 20 microns; and an average pit density ranging from about 1000 per millimeter square to about 30,000 per millimeter square.

12. The method of claim 6, wherein the mechanically fine-tuned surface texture comprises a plurality of pit structures separated by a plurality of pit protuberances, wherein each of the pit structures and the pit protuberances has a cross-sectional shape selected from the group consisting of a square, a rectangle, a circle, a triangle, a star, and a combination thereof.

13. The method of claim 6, wherein the mechanically fine-tuned surface texture comprises a hierarchical surface texture having one or more periodical structures on two or more scales.

14. The method of claim 6, wherein the mechanically fine-tuned surface texture has an oil consumption rate ranging from about 0.5 microliters per page to about 15 microliters per page, wherein the oil comprises a release oil.

15. A solid ink jet marking system comprising:

an aluminum image drum comprising a surface texture having an average surface roughness ranging from about 0.1 microns to about 0.6 microns, and a bearing area ranging from about 5% to about 95% at a cut depth ranging from about 0.1 microns to about 0.7 microns; wherein a relationship between the bearing area and the cut depth is selected from one or more sets comprising:

the bearing area ranging from about 7% to about 46% at the cut depth ranging from about 0.1 microns to about 0.2 microns;

the bearing area ranging from about 18% to about 74% at the cut depth ranging from about 0.2 microns to about 0.3 microns;

the bearing area ranging from about 32% to about 82% at the cut depth ranging from about 0.3 microns to about 0.4 microns;

the bearing area ranging from about 47% to about 86% at the cut depth ranging from about 0.4 microns to about 0.5 microns;

the bearing area ranging from about 60% to about 89% at the cut depth ranging from about 0.5 microns to about 0.6 microns; and the bearing area ranging from about 70% to about 95% at the cut depth ranging from about 0.6 microns to about 0.7 microns; and a printhead comprising a plurality of printhead nozzles configured to jet inks onto the aluminum image drum; wherein the aluminum image drum is configured in contact with a print medium to transfer the jetted inks from the aluminum image drum to the print medium.

16. The system of claim 15, wherein the aluminum image drum has an oil consumption rate ranging from about 0.5 microliters per page to about 15 microliters per page, wherein the oil comprises a release oil.

17. The system of claim 15, wherein the surface texture comprises an average maximum profile peak height of about 0.2 microns to about 0.6 microns.

18. The system of claim 15, wherein the surface texture has an average pit size ranging from about 0.1 microns to about 20 microns, and an average pit density ranging from about 1000 per millimeter square to about 30,000 per millimeter square.

19. The system of claim 15, wherein the aluminum image drum comprises at least about 97% Aluminum; less than about 2% Manganese; and less than about 1% Iron by weight of the total aluminum image drum.

20. The system of claim 15, wherein the surface texture of the aluminum image drum comprises an aluminum oxide having a thickness ranging from about 2 microns to about 22 microns.

* * * * *